United States Patent [19]

Doyle

[11] 4,331,018

[45] May 25, 1982

[54] FOLDING MACHINE

[75] Inventor: John B. Doyle, Rotherham, England

[73] Assignee: Keeton Sons & Co. Ltd., Sheffield, England

[21] Appl. No.: 147,425

[22] Filed: May 6, 1980

[30] Foreign Application Priority Data

May 16, 1979 [GB] United Kingdom ..... 7917003

[51] Int. Cl.[3] ..... B21D 5/01

[52] U.S. Cl. ..... 72/389

[58] Field of Search ..... 72/389, 386, 380, 319, 72/450, 404, 429, 379; 270/444

[56] References Cited

U.S. PATENT DOCUMENTS

| | | | |
|---|---|---|---|
| 1,434,068 | 10/1922 | Schlafly | 72/379 |
| 3,552,179 | 1/1971 | Kapustin | 72/389 |
| 4,080,814 | 3/1978 | Eaton | 72/389 |

FOREIGN PATENT DOCUMENTS

| | | |
|---|---|---|
| 138669 | 1/1953 | Sweden . |
| 985732 | 3/1965 | United Kingdom . |

*Primary Examiner*—Gene P. Crosby

*Attorney, Agent, or Firm*—Merriam, Marshall & Bicknell

[57] ABSTRACT

A folding machine has a pair of longitudinally extending folding members which in a rest position shown in chain dotted outline have horizontal co-planar upper surfaces. A holding tool 41 holds a workpiece 42 on the folding members. To produce a fold or bend, the folding members are swung upwardly and outwardly about a common axis to form the workpiece around the holding tool. The adjacent edges of the folding members have interengaging projections and recesses so that the folding members overlap each other in the rest position.

2 Claims, 5 Drawing Figures

FOLDING MACHINE

BACKGROUND TO THE INVENTION

The invention relates to folding machines.

A folding machine is described in U.K. Patent Specification No. 985,732 which comprises a pair of folding members mounted for pivotal movement in opposed directions about a common pivot axis from a rest position in which the upper surfaces of the forming members are co-planar to a folding position in which each of said upper surfaces are inclined to each other and a holding tool located above said axis and moveable into contact with a sheet metal or other workpiece laid across the upper surfaces of the folding members in their rest position to provide a stationary fold guide during the folding operation.

The folding machine can be used with a small radius holding tool in which case the pivot axis of the forming members almost coincides with the edge of the hold down tool. The upper surfaces of the folding members are then little more than the thickness of the workpiece away from the pivot axis so that during a bending operation there is very little movement of the position of the folding members.

However, when it is intended to produce a fold other than a simple angle, for example a fold of a finite larger radius, the holding tool should be of a shape to correspond to the required fold and the distance of the pivot axis from the surface of the folding members may be substantial. In the example of a fold of finite radius, the distance from the folding members to the pivot axis should be equal to the required radius of the fold plus the thickness of the material to be folded. In this kind of situation, a substantial gap opens up between the folding members during the folding operation and this can be detrimental to the function of the machine. For some folds the workpiece can drop down between the folding members. A thin workpiece can spring out into the gap and be pinched or distorted by the return stroke of the folding members.

An object of the present invention is to provide an improved folding machine in which these disadvantages are alleviated.

SUMMARY OF THE INVENTION

According to the present invention a folding machine of the kind comprising a pair of folding members mounted for pivotal movement in opposed directions about a common pivot axis from a rest position in which the upper surfaces of the folding members are co-planar to a folding position in which the said upper surfaces are inclined to each other and a hold down tool located above the said axis and moveable into contact with a sheet metal or other workpiece laid across the upper surfaces of the folding members in their rest position to provide a stationary fold guide during the folding operation is characterised by co-operating lateral recesses and projections in the upper surfaces of the folding members so that parts of the surfaces overlap each other in the rest position and continue to overlap in at least initial movement towards the folding position.

Preferably the co-operating recesses and projections are such as to provide a zig-zag line of contact between their upper surfaces.

BRIEF DESCRIPTION OF THE DRAWINGS

An embodiment of the invention will now be described by way of example only with reference to the accompanying drawings in which.

DESCRIPTION OF PREFERRED EMBODIMENTS

Figure 1:
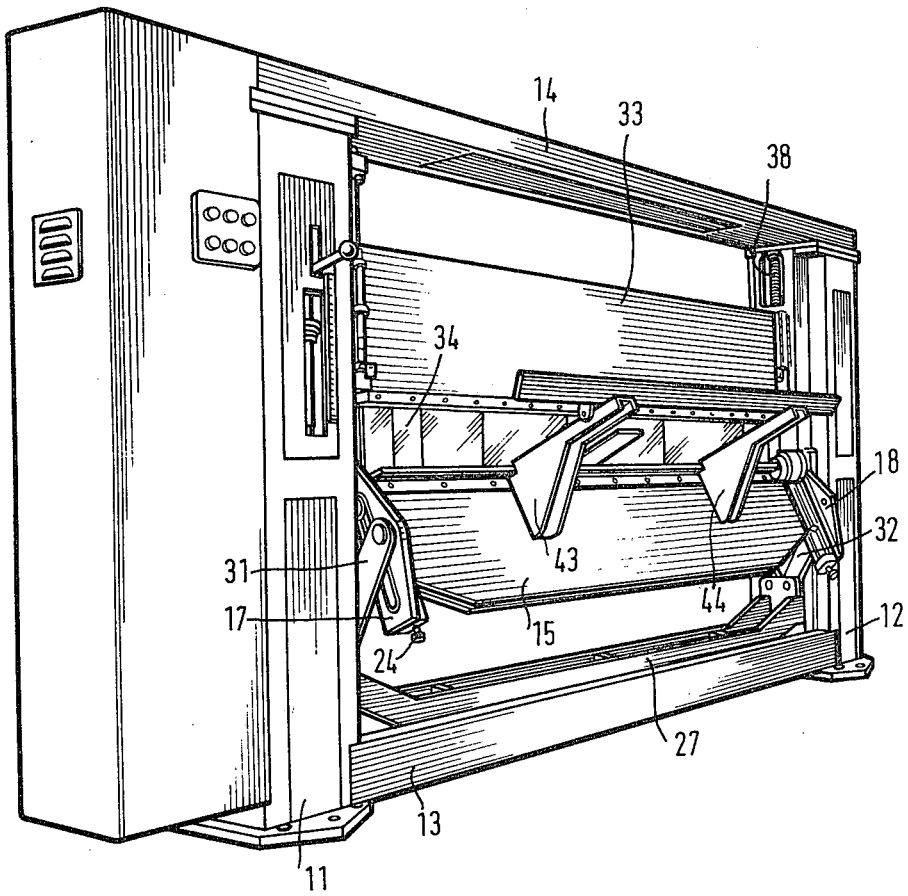
FIG. 1. PRIOR ART
FIG. 1 is a perspective view of the kind of folding machine to which the invention relates.
Figure 2:
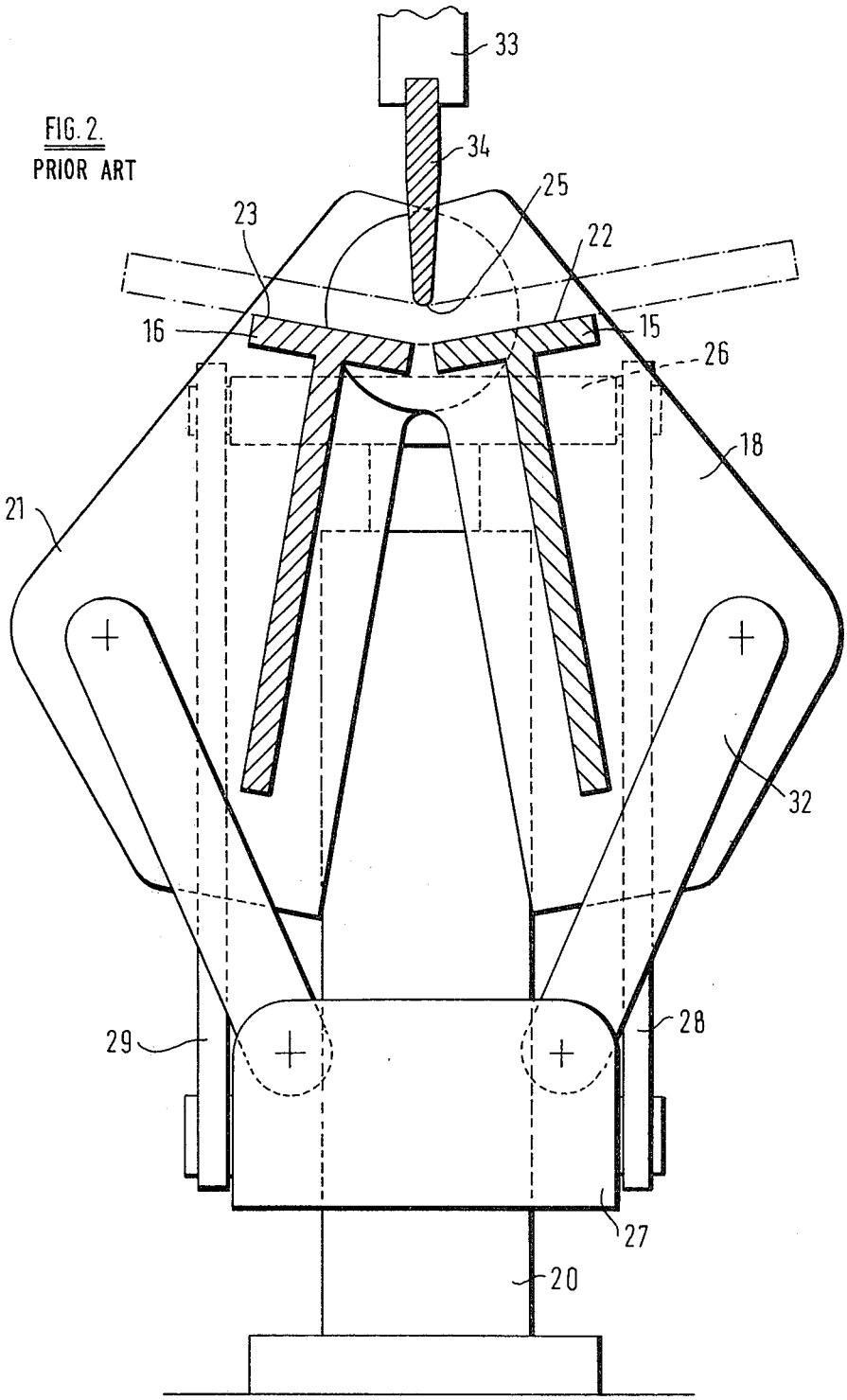
FIG. 2. PRIOR ART
FIG. 2 is a diagrammatic cross sectional view showing the basic operating parts of the machine of FIG. 1.

The folding machine shown in FIGS. 1 and 2 corresponds to the machine described in U.K. Patent Specification No. 985,732 the disclosure of which is incorporated herein by reference and for that reason only the basic features of the machine will be described herein. The machine comprises a fixed frame constituted by two upright end members 11 and 12, two transverse lower frame members 13 and a transverse upper frame member 14. Two folding members 15 and 16 are each supported at each end on pivoting supports such as the supports 17 and 18 for the folding member 15. One pivoting support 21 for the folding member 16 is also shown in FIG. 2. The folding members have upper surfaces 22 and 23 respectively which in the rest position of the machine are in a common horizontal plane. The height of the folding members is adjustable on their pivoting supports by adjustment means such as the screw adjuster 24 for support 17 to allow the upper surfaces 22 and 23 in the rest position to be a required distance below the pivot axis 25 of the pivoting supports. In use, the folding members also pivot about this pivot axis.

Pivoting movement of the folding members is provided by two hydraulic cylinders, one in each upright end member and one of which is shown diagrammatically at 20 in FIG. 2. The fixed hydraulic cylinder 20 is arranged to lift a trunion 26 which in turn lifts a longitudinal lifting beam 27 by means of links 28 and 29. The lifting beam 27 extends from one upright end member to the other and can be raised or lowered by two similar mechanisms, one at each end. The lifting beam is connected by two pairs of struts such as 31 and 32 to the pivoting supports such as 17 and 18 so that raising of the lifting beam pivots the supports in an outward direction and correspondingly pivots the folding members 15 and 16 in an upward and outward direction. FIG. 1 and in particular FIG. 2 show a position in which some upward and outward pivoting action has occurred from the rest position.

The press also incorporates a holding bar 33 which extends between the two upright end members 11 and 12 and is adjustable in height by means of a threaded adjuster 38 operated from an electric motor (not shown). The holding bar 33 carries a holding tool 34 which, in the example of FIG. 1, is in the form of a number of short segments.

In use of the conventional machine thus far described, the holding bar and its holding tool are raised to allow a sheet of metal to be inserted. The folding members are in their rest position with their upper surfaces 22 and 23 horizontal and in contact with each other. The height of the folding members is adjusted so that the upper surfaces 22 and 23 are below the pivot axis 25 by a distance equal to the thickness of the material to be formed plus the radius of the holding tool. A sheet of material is then positioned on the horizontal surfaces 22 and 23 with the required fold line immediately below the holding tool 34. The holding tool 34 is then lowered until its centre of curvature coincides with the pivot 25. In this position it is in contact with and holds the sheet to be formed. The hydraulic cylinders such as 20 are then pressurised to lift the lifting beam 27 and thereby swing the folding members upwardly and outwardly about their pivot axis 25. This action forms a bend in the workpiece.

The machine is equipped with adjustable stops and other controls to facilitate setting of the machine and to control the angle of the fold.

Figure 4:
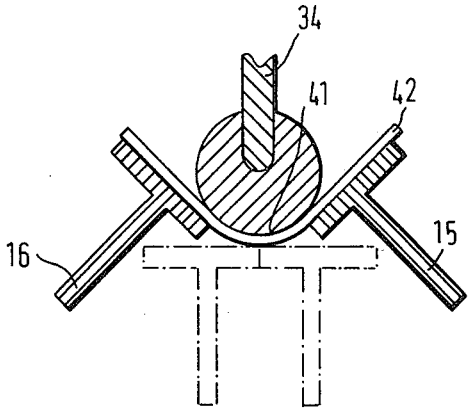
FIG. 4. PRIOR ART
FIG. 4 is a diagram showing the folding operation of a finite radius curve using the known folding machine.

FIG. 4 shows diagrammatically tooling which may be used with the machine of FIGS. 1 and 2 to produce a form other than a simple bend. In FIG. 4, the holding tool incorporates a circular section lower edge 41 about which sheet material 42 can be formed by the folding members 15 and 16. The heights of the folding members and holding tool are adjusted so that the pivot axis of the folding members coincides with the centre of curvature of the lower edge 41 of the holding tool. As can be seen in FIG. 4, during the folding operation the folding members move from the rest position shown in chain dotted outline to the position shown in full where a bend of approximately 90 degrees has been achieved. In order to release the formed workpiece 42, it is necessary first of all to return the folding members 15 and 16 to their rest position. As the corners of these folding members are in contact with the workpiece and firmly pressed against it by residual bending stresses in the workpiece, there is a tendency for the downward and inward movement of the folding members to grip the workpiece and to cause it to buckle and become crimped between the folding members rather than allowing the folding members to slide over the workpiece. There is also a tendency, with some shapes of hold down tool and particularly with large angles of bend, for the workpiece to drop down into the gap between the two folding members.

Figure 3:
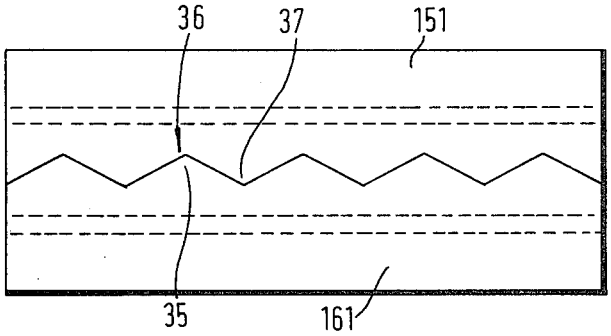
FIG. 3 is a plan view of the forming members of a folding machine according to the invention.

In accordance with the present invention this problem is alleviated by using folding members as illustrated in FIG. 3. The folding members 151 and 161 of FIG. 3 correspond in most respects to those of FIGS. 1 and 2 but the inner edges of the upper surfaces of the folding members have alternate projections such as 35 for folding member 161 and corresponding recesses such as 36 in the folding member 151 which co-operate with each other so that the projections of each folding member overlap the other forming member. In this example, the projections and recesses are triangular in shape so as to provide a zig-zag line of contact between the two folding members.

Figure 5:
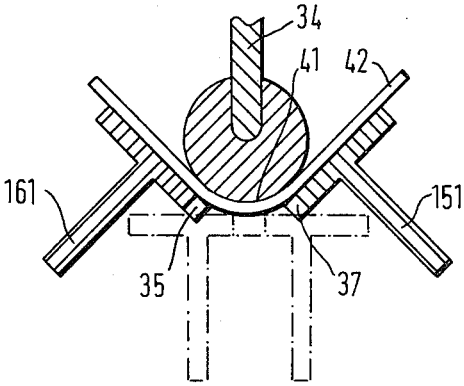
FIG. 5 is a view corresponding to FIG. 4 showing a folding machine of the present invention.

FIG. 5 is a view corresponding to FIG. 4 but showing use of the folding members of the present invention. The projections 35 and 37 on the two folding members cause the edges of these folding members to extend beyond the workpiece in an inward direction and so partially close the gap between the folding members. In the rest position and positions near the rest position, the projections overlap each other. This arrangement tends to prevent a workpiece from falling through the gap between the folding members. Also, during the return stroke of the folding members towards the rest position, the projections act as guides which hold the workpiece in contact with the tool 41. In this way the projections tend to prevent distortion of the workpiece during the return stroke.

I claim:

1. A folding machine of the kind comprising a pair of folding members each defining a flat upper surface and mounted for pivotal movement in opposed directions about a common pivot axis, means for pivoting said folding members from a rest position in which the upper surfaces of the forming members are co-planar, to a folding position in which the said upper surfaces are inclined to each other; a holding tool located above the said axis; means for moving the holding tool into contact with a sheet metal or other workpiece laid across the upper surfaces of the folding members in their rest position to provide a stationary fold guide during the folding operation wherein the improvement comprises the provision of projections extending from the opposed edges of the folding members which are interengaged with complimentary recesses formed in said edges, the upper surfaces of said projections being co-planar with the upper surfaces of the respective folding members, whereby, in use, the projections and recesses are in their interengaged relationship with one another in the rest position of the folding members and during initial pivotal movement of said members towards the folding position.

2. A folding machine as claimed in claim 1 in which the co-operating projections and recesses are such as to provide a zig-zag line of contact between their upper surfaces.

* * * * *